US008998194B2

(12) United States Patent
Okamoto

(10) Patent No.: US 8,998,194 B2
(45) Date of Patent: Apr. 7, 2015

(54) IMAGE FORMING APPARATUS

(71) Applicant: Sony Corporation, Tokyo (JP)

(72) Inventor: Hidetaka Okamoto, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 14/338,784

(22) Filed: Jul. 23, 2014

(65) Prior Publication Data

US 2015/0035224 A1 Feb. 5, 2015

(30) Foreign Application Priority Data

Jul. 30, 2013 (JP) ..... 2013-158050

(51) Int. Cl.
*B65H 3/00* (2006.01)
*B65H 7/20* (2006.01)
*B65H 3/06* (2006.01)

(52) U.S. Cl.
CPC .. *B65H 3/00* (2013.01); *B65H 7/20* (2013.01); *B65H 3/06* (2013.01)

(58) Field of Classification Search
USPC ..... 271/18, 19, 161
See application file for complete search history.

(56) References Cited

U.S. PATENT DOCUMENTS

| | | | | |
|---|---|---|---|---|
| 6,149,045 | A * | 11/2000 | Kadono | 226/196.1 |
| 7,198,420 | B2 * | 4/2007 | Yamamoto et al. | 400/625 |
| 7,845,630 | B2 * | 12/2010 | Hung et al. | 271/121 |
| 7,950,650 | B2 * | 5/2011 | Koyanagi | 271/161 |
| 8,472,857 | B2 * | 6/2013 | Matsuno | 399/388 |
| 8,672,316 | B2 * | 3/2014 | Chiwata | 271/161 |
| 2013/0135697 | A1 * | 5/2013 | Ukai | 358/498 |
| 2013/0320610 | A1 * | 12/2013 | Bingham et al. | 271/10.09 |

FOREIGN PATENT DOCUMENTS

| | | | |
|---|---|---|---|
| JP | 2006-076717 | A | 3/2006 |
| WO | 03-078287 | A1 | 9/2003 |

* cited by examiner

*Primary Examiner* — Patrick Cicchino
(74) *Attorney, Agent, or Firm* — Sheridan Ross P.C.

(57) ABSTRACT

There is provided an image forming apparatus including separating members in a conveyance direction of sheets conveyed from a paper tray, the separating members being configured to separate the sheets one by one. The separating members include an upward regulating member configured to regulate a central part of a sheet in a width direction in a manner that the central part of the sheet points upward, and downward regulating members on both sides of the upward regulating member, the downward regulating members each being configured to regulate both ends of the sheet in the width direction in a manner that both ends of the sheet point downward. A position of an upper end of the upward regulating member is higher than a position of a lower end of each downward regulating member.

6 Claims, 5 Drawing Sheets

IMAGE FORMING APPARATUS

CROSS REFERENCE TO RELATED APPLICATIONS

This application claims the benefit of Japanese Priority Patent Application JP 2013-158050 filed Jul. 30, 2013, the entire contents of which are incorporated herein by reference.

BACKGROUND

The present disclosure relates to an image forming apparatus including a mechanism for preventing sheets from being multi-fed.

Image forming apparatuses such as printers each pick up and convey sheets accommodated in a paper tray to an image forming position with a rotating paper feed roller. The sheets are picked up through friction between the paper feed roller and the sheets, but static electricity between the sheets which is accumulated in the paper tray, friction, or humidity sometimes causes multi-feeding, which means the paper feed roller conveys a plurality of sheets sticking together.

For example, JP 2006-76717A discloses an image forming device including a separation wall formed to protrude upward and to oppose to a paper feeding roller in order to prevent sheets from being multi-fed. For example, WO 03/078287 discloses a sheet feeder including a separation wall of a sheet tray on which a convex part widening in a paper feeding direction or a concave part narrowing in the paper feeding direction is formed.

SUMMARY

A plurality of sheets is, however, possibly conveyed over an inclined plane of the separation wall in the image forming device disclosed in JP 2006-76717A. The sheet feeder disclosed in WO 03/078287 can separate sheets by transforming the tips of the sheets along the convex or concave part on the separation wall and increasing rigidity of the sheets even though the sheets are thin. Bending a sheet in a width direction of the sheet may, however, decrease an area of contact of a pickup roller with the sheet, leading to reduced reliability of paper feeding.

The present disclosure therefore proposes a novel and improved image forming apparatus that can reliably separate sheets when the sheets are fed, and prevent sheets from being multi-fed.

According to an embodiment of the present disclosure, there is provided an image forming apparatus including separating members in a conveyance direction of sheets conveyed from a paper tray, the separating members being configured to separate the sheets one by one. The separating members include an upward regulating member configured to regulate a central part of a sheet in a width direction in a manner that the central part of the sheet points upward, and downward regulating members on both sides of the upward regulating member, the downward regulating members each being configured to regulate both ends of the sheet in the width direction in a manner that both ends of the sheet point downward. A position of an upper end of the upward regulating member is higher than a position of a lower end of each downward regulating member. The upper end of the upward regulating member is positioned in a more upstream conveyance direction of the sheet than a tip of each downward regulating member is.

According to another embodiment of the present disclosure, an upward regulating member and downward regulating members are arranged to overlap with each other in a conveyance direction of sheets and a height direction of an image forming apparatus such that sheets conveyed from a paper tray are separated one by one. This transforms the topmost sheet into an upward convex shape when the topmost sheet passes between the upward regulating member and the downward regulating members, allowing both ends of the sheet in the width direction of the sheet to hold a sheet beneath. Consequently, the sheet beneath is unable to go beyond the upward regulating member, and the topmost sheet alone is conveyed. In this way, it is possible to reliably separate sheets one by one when the sheets are fed from a paper tray, and to prevent sheets from being multi-fed. Preventing sheets from being multi-fed can also reduce printing failure occurrence in the image forming apparatus.

According to one or more of embodiments of the present disclosure, it is possible to reliably separate sheets when the sheets are fed, and to prevent sheets from being multi-fed.

DETAILED DESCRIPTION OF THE EMBODIMENT(S)

Figure 1:
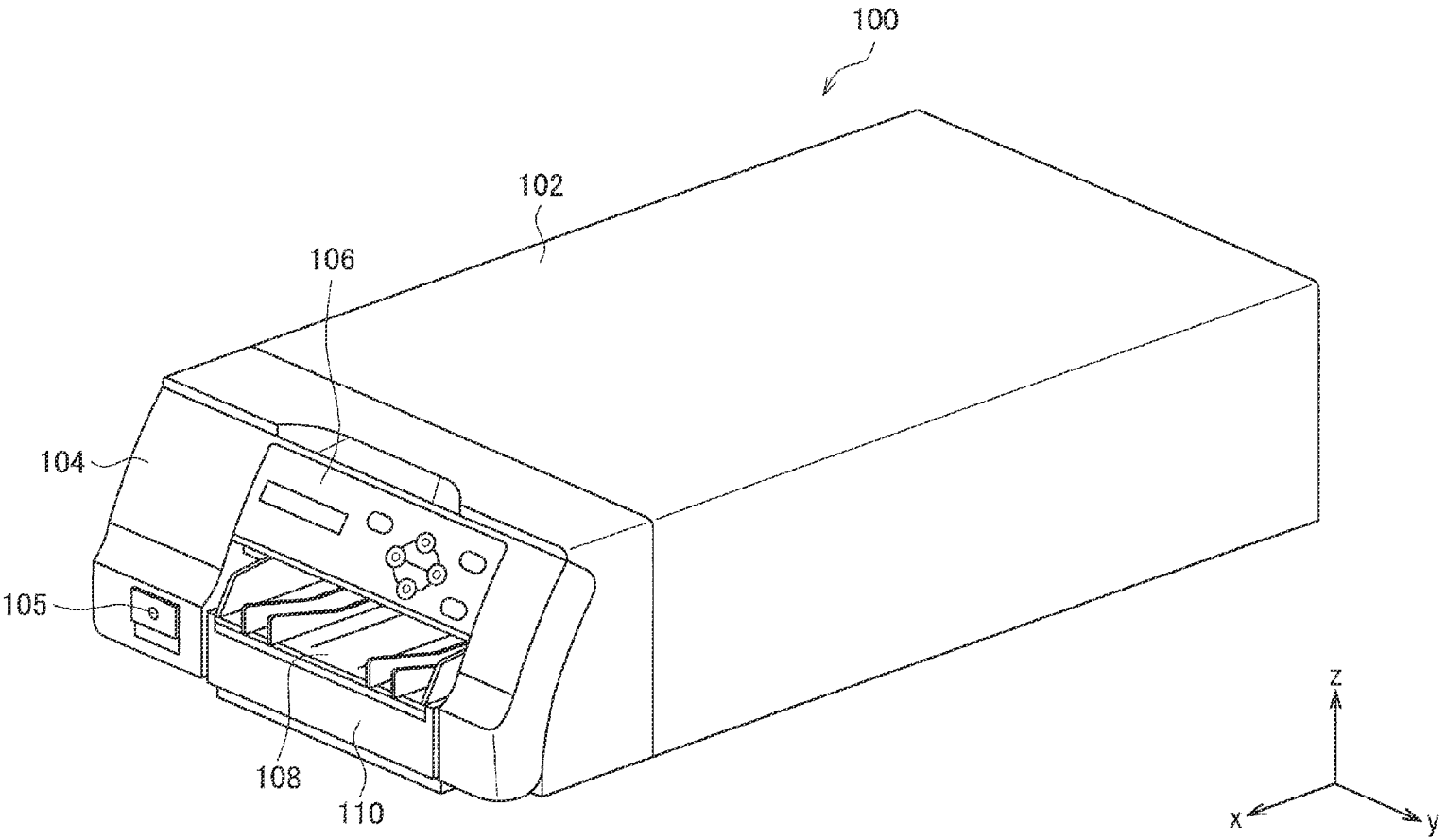
FIG. 1 is an overall perspective view illustrating an exterior of an image forming apparatus according to an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The description will be made in the following order.

1. Schematic Configuration of Image Forming Apparatus
2. Separation of Sheets when Sheets Are Fed
   2.1. Configuration of Separating Members
   2.2. Separation of Sheets by Separating Members
   2.3. Adjustment of Separating Members <1. Schematic Configuration of Image Forming Apparatus>

A schematic configuration of an image forming apparatus according to an embodiment of the present disclosure will be now described with reference to FIG. 1. FIG. 1 is an overall perspective view illustrating an exterior of an image forming apparatus 100 according to the present embodiment.

The image forming apparatus 100 according to the present embodiment prints data on a target, the data being input from devices such as computers and digital cameras connected to the image forming apparatus 100. Examples of the image forming apparatus 100 include printers and copiers. The image forming apparatus 100 as illustrated in FIG. 1 is a thermal transfer printer that transfers inks applied on tapes to sheets. Although the image forming apparatus 100 will be described as a thermal transfer printer in the present embodiment, an embodiment of the present technology is not limited thereto. Thermal printers, ink jetprinters, and dry electrophotographic printers and copiers may also be adopted.

The image forming apparatus 100 as illustrated in FIG. 1 includes a main body 102 accommodating a print unit (not shown) that prints data on a sheet accommodated in a paper tray 110, and a front section 104 on the front surface (surface in the positive direction of the x-axis) of the main body 102, the front section 104 being capable of opening and closing. An operation section 106 including a power button 105, an operation button, and a display panel for the image forming apparatus 100 is arranged on the front section 104. The paper tray 110 that accommodates a sheet is installed at a lower part of the front section 104 and a sheet can be put into and removed from the paper tray 110 in the x-axial direction. An outlet 108 is installed at an upper part of the paper tray 110, and a sheet which has been picked up from the paper tray 110 and the print unit has printed data on is ejected from the outlet 108.

<2. Separation of Sheets when Sheets are Fed>

When printing data on sheets, the image forming apparatus 100 according to the present embodiment picks up sheets stacked in the paper tray 110 with a paper feed roller, and conveys the sheets to an image forming position with the print unit. The image forming apparatus 100 according to the present embodiment includes separating members that separate fed sheets in order to reliably separate and convey the sheets one by one when the sheets are fed by the paper feed roller.

[2.1. Configuration of Separating Members]

The separating members are installed in a conveyance path in a downstream conveyance direction with respect to the paper feed roller, and sheets accommodated in the paper tray 110 are conveyed to the image forming position through the conveyance path. The separating members according to the present embodiment include downward regulating members that regulate a direction of a sheet conveyed from the paper tray 110 such that both ends of the sheet in the width direction of the sheet point downward, and an upward regulating member that regulates a direction of a sheet such that the central part of the sheet in the width direction of the sheet points upward. Such separating members transform sheets passing between the downward regulating members into upward convex shapes, allowing the sheets to be conveyed one by one. The separating members are installed, for example, on a structure in the main body 102.

Figure 2:
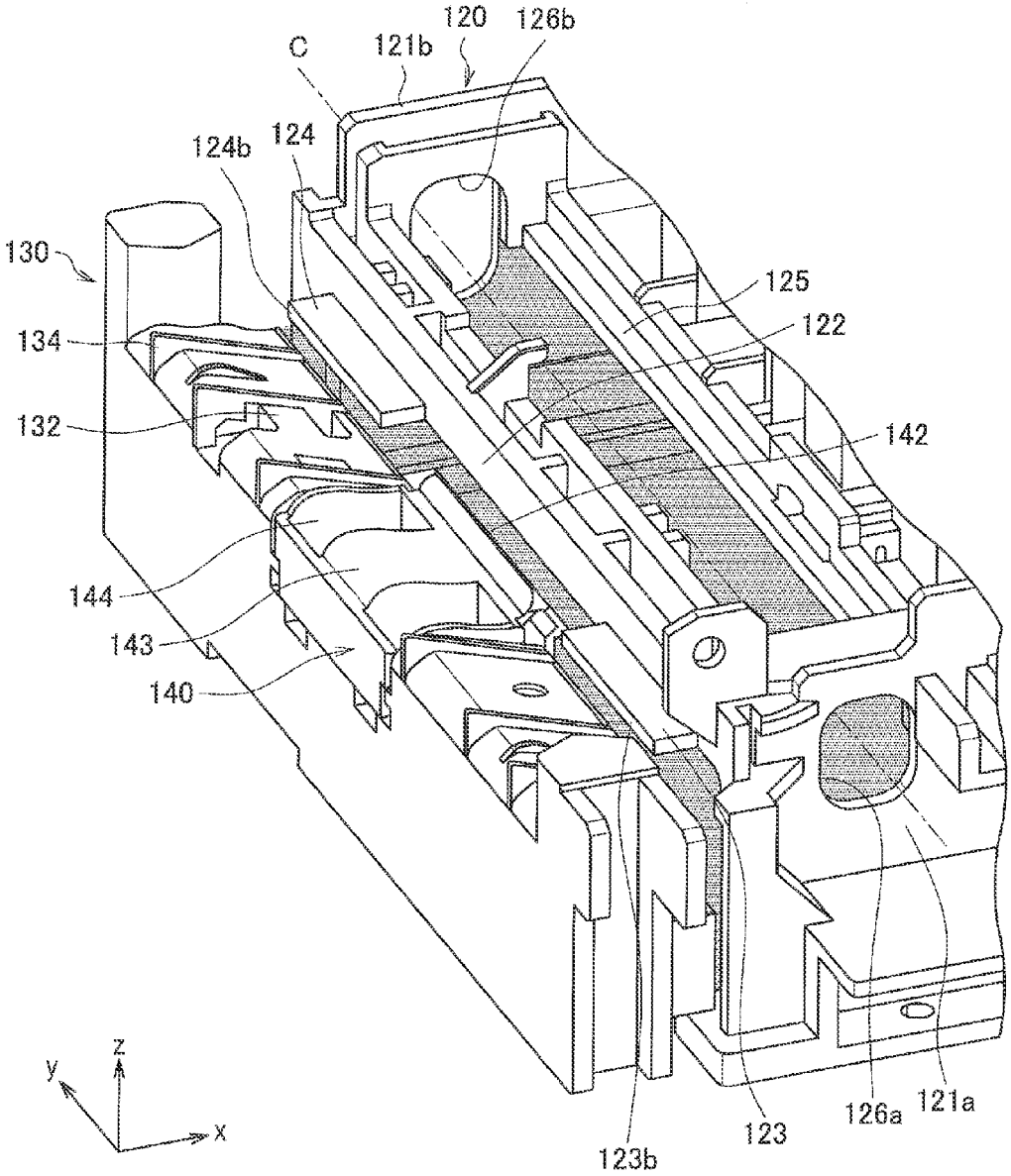
FIG. 2 is a partial perspective view illustrating a part of structures in a main body according to the embodiment.

FIG. 2 illustrates a part of structures in the main body 102. A first structure 120 is a member surrounding the paper tray 110 accommodated in the main body 102. The first structure 120 includes side sections 121*a* and 121*b* and ceiling sections 122 and 125 that couple the side section 121*a* with the side section 121*b*. The paper tray 110 is accommodated in the space defined by the side sections 121*a* and 121*b* and the ceiling sections 122 and 125. The side sections 121*a* and 121*b* have openings 126*a* and 126*b*, the opening 126*a* and 126*b* facing each other in the width direction (y direction) of the main body 102. Both ends of a paper feed roller (numbered 150 in FIG. 3) arranged in parallel with a rotational center axis C in the y direction are inserted through the openings 126*a* and 126*b*.

Downward regulating members 123 and 124 included in the separating members are attached to the ceiling section 122, which is arranged behind (negative direction of the x-axis) the position of the paper feed roller. The downward regulating members 123 and 124 protrude from the ceiling section 122 in the conveyance direction (negative direction of the x-axis) of sheets. The downward regulating members 123 and 124 have a predetermined length and are attached onto both sides of the ceiling section 122 symmetrically with respect to the center of the ceiling section 122 in the width direction (y direction).

A second structure 130 is installed behind the first structure 120. The second structure 130 is installed across the main body 102 in the width direction (y direction) of the main body 102, and forms a part of the conveyance path, through which sheets picked up from the paper tray 110 are conveyed to the image forming position. The sheets picked up from the paper tray 110 pass a top face 132 of the second structure 130. The top face 132 slopes up in the conveyance direction (negative direction of the x-axis) of the sheets, and includes a plurality of ribs 134 at predetermined intervals in the width direction.

The second structure 130 includes an upward regulating member 140 at the center on the top face 132 in the width direction, the upward regulating member 140 being included in separating members for sheets. The upward regulating member 140 is arranged such that an upper end 142 is positioned between the downward regulating members 123 and 124. The center of the upward regulating member 140 in the width direction may then be aligned with the center of the ceiling section 122 in the width direction. This symmetrically arranges the separating members with respect to the center in the width direction, allowing sheets passing between the downward regulating members 123 and 124 and the upward regulating member 140 to be symmetrically bent with respect to the center in the width direction. Transforming sheets in this way allows force used for both ends of the topmost sheet to hold a sheet beneath to be substantially equally applied.

The downward regulating members 123 and 124 and the upward regulating member 140 are arranged in the present embodiment such that the three members have substantially the same length in the width direction of the image forming apparatus 100. The length in the width direction can be varied as desired. The downward regulating members 123 and 124 may, for example, have a greater length in the width direction than the upward regulating member 140 does, and vice versa.

Figure 3:
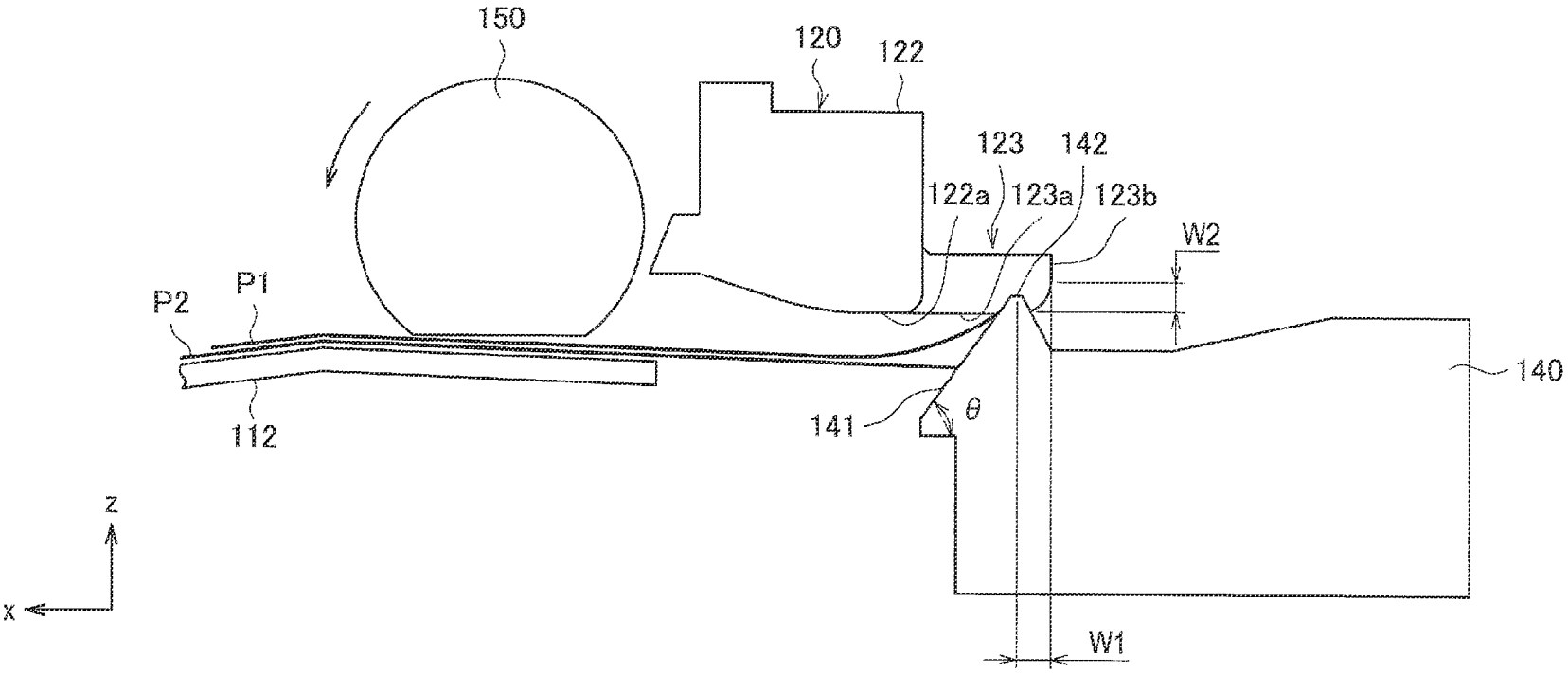
FIG. 3 is an explanatory diagram illustrating a state of a sheet picked up by a paper feed roller, as viewed from the side.
Figure 4:
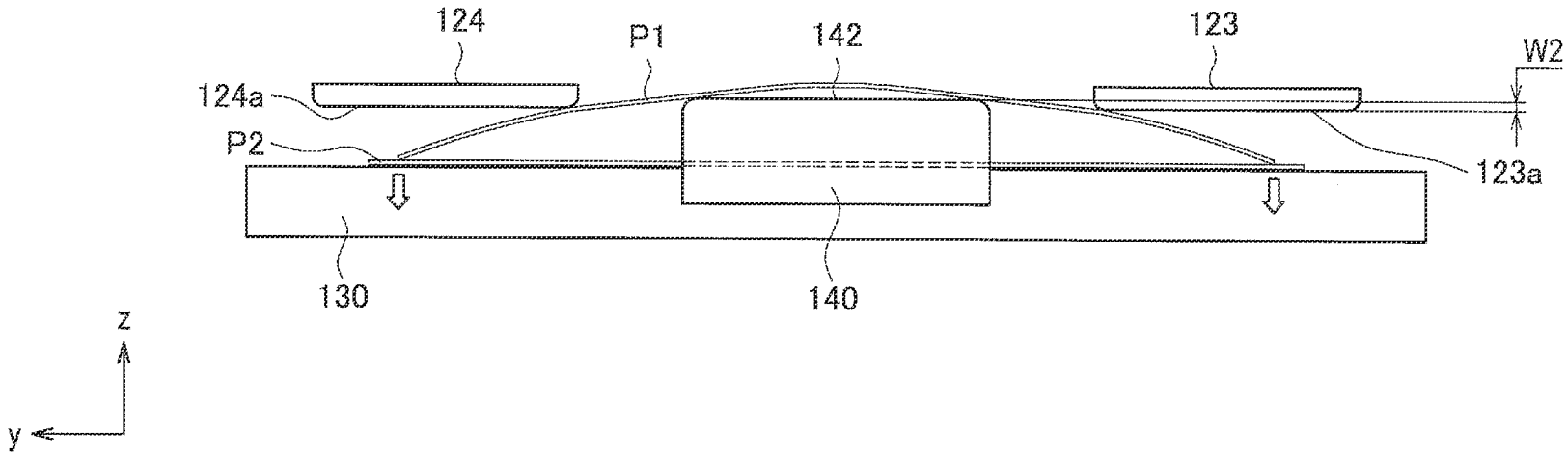
FIG. 4 is an explanatory diagram illustrating a state of a sheet picked up by the paper feed roller when the sheet is passing separating members, showing an upstream area viewed from a downstream side in a conveyance direction of the sheet.

The separating members will be described in detail on the basis of FIGS. 2 to 4. FIG. 3 is an explanatory diagram illustrating a state of a sheet picked up by a paper feed roller 150, as viewed from the side. FIG. 4 is an explanatory diagram illustrating a state of a sheet picked up by the paper feed roller 150 when the sheet is passing separating members, showing an upstream area viewed from a downstream side in a conveyance direction of the sheet.

The separating members include the two downward regulating members 123 and 124 on the ceiling section 122 of the first structure 120, and the upward regulating member 140 on the second structure 130.

The downward regulating members 123 and 124 are plate members installed so as to protrude from the ceiling section 122 in the upstream conveyance direction of sheets. The downward regulating members 123 and 124 are formed in the same shape in the present embodiment, and arranged substantially symmetrically with respect to the center of the main body 102 in the width direction of the main body 102. As illustrated in FIG. 3, an undersurface 123*a* of the downward regulating member 123 is smoothly continuous with an undersurface 122*a* of the ceiling section 122. The tip of the undersurface 123*a* of the downward regulating member 123 may be rounded such that a sheet having passed the regulating members is smoothly conveyed. The downward regulating member 124 is formed in the same way as the downward regulating member 123.

The upward regulating member 140 includes an inclined plane 141 in the upstream conveyance direction of sheets, and a sheet picked up from the paper tray 110 by the paper feed roller 150 abuts the inclined plane 141. The inclined plane 141 slopes up from the horizontal plane by a predetermined inclination angle θ in the conveyance direction of sheets. If the inclination angle θ of the inclined plane 141 was too small, a plurality of sheets overlapping with each other would be likely to pass the upward regulating member 140. To the contrary, if the inclination angle was too large, a sheet would be likely to fail to pass the upward regulating member 140. Thus the inclination angle θ of the inclined plane 141 is set to such an appropriate value that sheets can be separated one by one. The inclination angle θ of the inclined plane 141 may be set, for example, to some 45 degrees to 50 degrees.

The downstream portion of the upward regulating member 140 from an upper end 142 of the inclined plane 141 in the conveyance direction of sheets may be contoured to correspond to the top face 132 of the second structure 130. In other words, the top face 143 of the upward regulating member 140 may slope up in the conveyance direction (negative direction of the x-axis) of sheets or may include a plurality of ribs 144 in the width direction.

The upward regulating member 140 on the second structure 130 is arranged to be positioned between the two downward regulating members 123 and 124 on the ceiling section 122 of the first structure 120 in the width direction. The upward regulating member 140 and the downward regulating members 123 and 124 are arranged to overlap with each other in the conveyance direction (x direction) of sheets and the height direction (z direction) of the image forming apparatus 100.

As to the conveyance direction (x direction) of sheets in the image forming apparatus 100, as illustrated in FIG. 3, the upper end 142 of the upward regulating member 140 is positioned in the more upstream conveyance direction of sheets than apical surfaces 123*b* and 124*b* of the downward regulating members 123 and 124. In other words, the upper end 142 of the upward regulating member 140 shifts by a distance w1 in the x-axial negative direction from the apical surfaces 123*b* and 124*b* of the downward regulating members 123 and 124. The distance w1 varies depending on a type of sheet used in the image forming apparatus 100. However, if the distance w1 was too long, smooth paper conveyance would be prevented. Accordingly, the distance w1 may be set to a small value such as some 1 mm.

As illustrated in FIG. 3, the upper end 142 of the upward regulating member 140 is higher than the undersurfaces 123*a* and 124*a* of the downward regulating members 123 and 124 in the height direction (z direction) of the image forming apparatus 100. In other words, the upper end 142 of the upward regulating member 140 shifts by a distance w2 in the z-axial positive direction from the undersurfaces 123*a* and 124*a* of the downward regulating members 123 and 124. The distance w2 also varies depending on a type of sheet used in the image forming apparatus 100. The distance w2 may be set to some 1 mm, for example.

In this way, the downward regulating members 123 and 124 and the upward regulating member 140 transform a sheet picked up by the paper feed roller 150 into an upward convex shape when the sheet passes between the downward regulating members 123 and 124 and the upward regulating member 140.

[2.2. Separation of Sheets by Separating Members]

As illustrated in FIG. 3, the rotation of the paper feed roller 150 allows sheets stacked in the paper tray 110 to pass through the space between the downward regulating members 123 and 124 and the upward regulating member 140, and to be conveyed to a print unit. Sheets P1 and P2 stacked on a placement section 112 of the the paper tray 110 are then moved by the paper feed roller 150 in the conveyance direction, and first abut the inclined plane 141 of the upward regulating member 140. After the sheets P1 and P2 abut the inclined plane 141, the paper feed roller 150 keeps on rotating. This allows the sheet P1 in contact with the paper feed roller 150 to keep on moving in the conveyance direction and to go beyond the upper end 142 of the inclined plane 141.

When the downward regulating members 123 and 124 and the upward regulating member 140 are viewed from the downstream side in the conveyance direction of sheets as illustrated FIG. 4, the central part of the sheet P1 is pushed up by the upward regulating member 140 at the center of the image forming apparatus 100 in the width direction. Since the central part of the sheet P1 has been pushed up, the top face of the sheet P1 comes into contact with the downward regulating members 123 and 124. Accordingly, both sides of the central part of the sheet P1 are pushed down, and both ends hold the sheet P2 under the sheet P1.

In other words, the separating members transform the sheet P1, which is being fed, into an upward convex shape, thereby assisting both ends of the sheet P1 in the width direction in holding the sheet P2 beneath such that the sheet P2 does not go beyond the upward regulating member 140. Consequently, the topmost sheet P1 alone goes beyond the upward regulating member 140 and is conveyed toward a print unit.

The separation of sheets by the separating members according to the present embodiment does not impose any load on the sheets being conveyed, allowing for natural conveyance. A paper feed roller is pressed against a rubber pad and sheets are separated by being passed between the paper feed roller and the rubber pad in the related art in order to separate, one by one, a plurality of sheets picked up by the paper feed roller. Such an approach, however, imposes a heavy load on sheets when the sheets pass between a paper feed roller and a rubber pad. Loads are also imposed imposed on components of the image forming apparatus 100 such as a paper feed roller and a rubber pad. To the contrary, a method of separating sheets according to the present embodiment does not impose any heavy load on sheets or the components of the image forming apparatus 100 so that durability of the components can also be enhanced.

[2.3. Adjustment of Separating Members]

It changes the way of transformation of sheets how the downward regulating members 123 and 124 and the upward regulating members 140, which are included in the separating members, overlap with each other. For example, a sheet having high rigidity can adequately hold a sheet beneath with both ends in the width direction even though the sheet bent by the separating members has a small curvature. In this case, the downward regulating members 123 and 124 and the upward regulating member 140 do not have to overlap with each other much. To the contrary, a sheet having low rigidity can only hold a sheet beneath weakly with both ends in the width direction if a curvature of the sheet bent by the separating members is too small.

Figure 5:
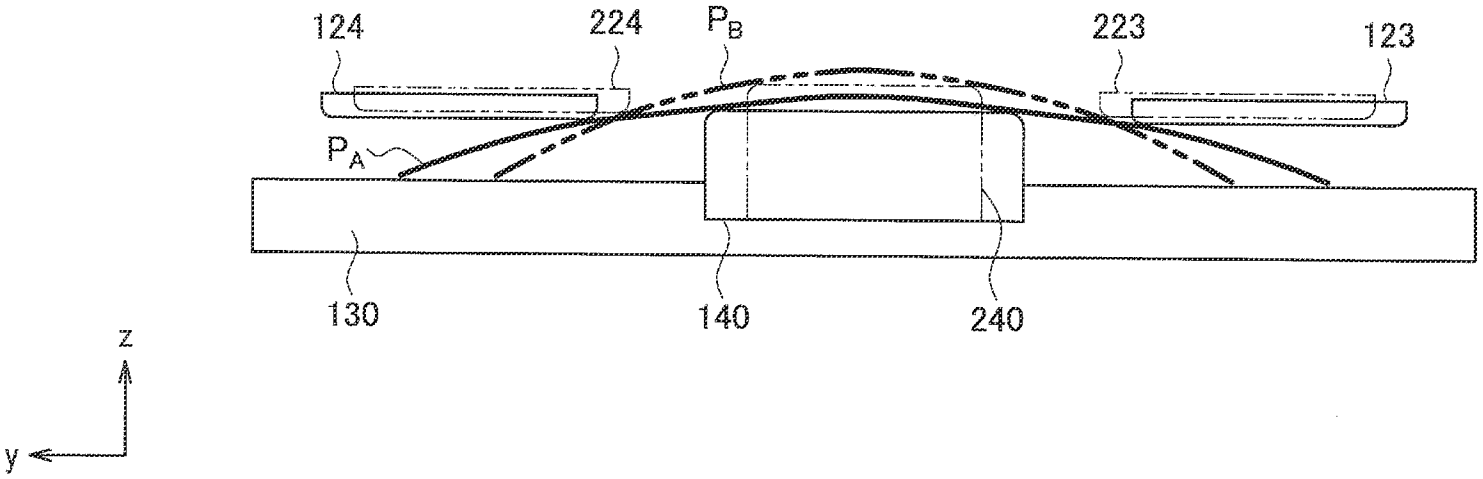
FIG. 5 is an explanatory diagram describing a relationship between the arrangement of an upward regulating member and downward regulating members and transformation of a sheet.

Thus, if the arrangement of the separating members of the image forming apparatus 100 can be changed as desired, it is also possible to change how to transform sheets passing the separating members when the sheets are fed, depending on a type of sheet. FIG. 5 illustrates a relationship between the arrangement of the upward regulating member and the downward regulating members and transformation of sheets. Sheets $P_A$ and $P_B$ have different rigidity in FIG. 5, and let us assume that the sheet $P_A$ has higher rigidity than rigidity of the sheet $P_B$.

When the sheet $P_A$ is used in the image forming apparatus 100, the separating members are arranged like the upward regulating member 140 and the downward regulating members 123 and 124. Meanwhile, when the sheet $P_B$ is used, the separating members are arranged like an upward regulating member 240 and downward regulating members 223 and 224 and overlap more with each other in the height direction than the case of the sheet $P_A$. Accordingly, the sheet $P_B$ is transformed much. The arrangement of the separating members is changed depending on a type of sheet used in the image forming apparatus 100 in this way so that sheets can be reliably prevented from being multi-fed.

Additionally, at least one of the downward regulating members 123 and 124 and the upward regulating member 140 included in the separating members may be moved in the height direction or the width direction in order to change a curvature of a sheet. Alternatively, the shape of at least one of the downward regulating members 123 and 124 and the upward regulating member 140 may also be changed in order to change a curvature of a sheet. If, for example, the upward regulating member 140 according to the present embodiment is detachably configured with respect to the second structure 130, it is possible to change the shape of the upward regulating member 140 in accordance with a type of sheet to obtain such a curvature of sheets that the shapes are appropriate for separating and conveying the sheets one by one.

The configuration of the image forming apparatus 100 according to the present embodiment and the configuration and the advantageous effects of the paper separating members installed thereon have been described above. The separating members of the image forming apparatus 100 according to the present embodiment are arranged such that the upward regulating member 140 and the downward regulating members 123 and 124 overlap with each other in the conveyance direction (x direction) of sheets and the height direction (y direction) of the image forming apparatus 100. This transforms the topmost sheet P1 into an upward convex shape when the topmost sheet P1 passes the separating members, allowing both ends of the sheet in the width direction to hold the sheet P2 beneath. Consequently, the sheet P2 beneath is unable to go beyond the upward regulating member 140 so the topmost sheet P1 alone is conveyed toward a print unit.

In this way, according to an embodiment of the present technology, it is possible to reliably separate sheets one by one when the sheets are fed and to prevent sheets from being multi-fed. Preventing sheets from being multi-fed can reduce printing failure occurrence in the image forming apparatus 100.

Although the preferred embodiments of the present disclosure have been described in detail with reference to the appended drawings, the present disclosure is not limited thereto. It is obvious to those skilled in the art that various modifications or variations are possible insofar as they are within the technical scope of the appended claims or the equivalents thereof. It should be understood that such modifications or variations are also within the technical scope of the present disclosure.

The separation mechanism is, for example, installed at a paper feeding position in the above-described embodiment at which sheets accommodated in the paper feed tray 110 are picked up by the paper feed roller 150, but an embodiment of the present disclosure is not limited thereto. The paper separation and conveyance mechanism such as the downward regulating members and the upward regulating member may be arranged at a position other than the paper feeding position, at which it is desired to reliably separate the sheets one by one, such that the sheet is transformed into an upward convex shape.

Additionally, the present technology may also be configured as below.

(1) An image forming apparatus including:
- separating members in a conveyance direction of sheets conveyed from a paper tray, the separating members being configured to separate the sheets one by one,
- wherein the separating members include
  - an upward regulating member configured to regulate a central part of a sheet in a width direction in a manner that the central part of the sheet points upward, and
  - downward regulating members on both sides of the upward regulating member, the downward regulating members each being configured to regulate both ends of the sheet in the width direction in a manner that both ends of the sheet point downward,
- wherein a position of an upper end of the upward regulating member is higher than a position of a lower end of each downward regulating member, and
- wherein the upper end of the upward regulating member is positioned in a more upstream conveyance direction of the sheet than a tip of each downward regulating member is.

(2) The image forming apparatus according to (1),
- wherein the upward regulating member and each downward regulating member transform the sheet into an upward convex shape when the sheet passes between the upward regulating member and each downward regulating member.

(3) The image forming apparatus according to (2),
- wherein the upward regulating member and each downward regulating member are installed in a manner that the upward regulating member and each downward regulating member are capable of changing a curvature of the sheet that passes between the upward regulating member and each downward regulating member.

(4) The image forming apparatus according to (3),
- wherein the upward regulating member and each downward regulating member are installed in a manner that the upward regulating member and each downward regulating member are movable in at least one of a height direction and the width direction of the sheet.

(5) The image forming apparatus according to any one of (1) to (4),
- wherein the upward regulating member and each downward regulating member are symmetrically arranged with respect to a center in the width direction.

(6) The image forming apparatus according to any one of (1) to (5),
- wherein the upward regulating member includes an inclined plane that each sheet conveyed from the paper tray abuts, and
- wherein the inclined plane slopes up in the conveyance direction of the sheet.

What is claimed is:

1. An image forming apparatus comprising:
- separating members in a conveyance direction of sheets conveyed from a paper tray, the separating members being configured to separate the sheets one by one,
- wherein the separating members include
  - an upward regulating member configured to regulate a central part of a sheet in a width direction in a manner that the central part of the sheet points upward, and downward regulating members on both sides of the upward regulating member, the downward regulating members each being configured to regulate both ends of the sheet in the width direction in a manner that both ends of the sheet point downward, wherein a position of an upper end of the upward regulating member is higher than a position of a lower end of each downward regulating member, and wherein the upper end of the upward regulating member is positioned in a more upstream conveyance direction of the sheet than a tip of each downward regulating member is.

2. The image forming apparatus according to claim 1, wherein the upward regulating member and each downward regulating member transform the sheet into an upward convex shape when the sheet passes between the upward regulating member and each downward regulating member.

3. The image forming apparatus according to claim 2, wherein the upward regulating member and each downward regulating member are installed in a manner that the upward regulating member and each downward regulating member are capable of changing a curvature of the sheet that passes between the upward regulating member and each downward regulating member.

4. The image forming apparatus according to claim 3, wherein the upward regulating member and each downward regulating member are installed in a manner that the upward regulating member and each downward regulating member are movable in at least one of a height direction and the width direction of the sheet.

5. The image forming apparatus according to claim 1, wherein the upward regulating member and each downward regulating member are symmetrically arranged with respect to a center in the width direction.

6. The image forming apparatus according to claim 1, wherein the upward regulating member includes an inclined plane that each sheet conveyed from the paper tray abuts, and wherein the inclined plane slopes up in the conveyance direction of the sheet.

* * * * *